US006536138B1

(12) United States Patent
Miralles

(10) Patent No.: US 6,536,138 B1
(45) Date of Patent: Mar. 25, 2003

(54) DEVICE FOR POSITIONING A PAIR OF OVERLAPPING FLAPS

(75) Inventor: Thierry Miralles, Marcellaz Albanais (FR)

(73) Assignee: Salomon S.A., Metz-Tessy (FR)

( * ) Notice: Subject to any disclaimer, the term of this patent is extended or adjusted under 35 U.S.C. 154(b) by 63 days.

(21) Appl. No.: 09/672,082

(22) Filed: Sep. 29, 2000

(30) Foreign Application Priority Data

Oct. 1, 1999 (FR) ..... 99 12414

(51) Int. Cl.[7] ..... A43C 11/00

(52) U.S. Cl. ..... 36/50.1; 36/50.5; 36/117.1; 24/70 SK

(58) Field of Search ..... 36/50.1, 50.5, 36/117.1; 24/70 SK, 71 SK, 68 SK

(56) References Cited

U.S. PATENT DOCUMENTS

| | | | | | |
|---|---|---|---|---|---|
| 171,301 | A | * | 12/1875 | McKee | 36/50.1 |
| 195,414 | A | * | 9/1877 | Steinhauer | 36/50.1 |
| 376,055 | A | * | 1/1888 | Hopkins | 24/68 SK |
| 3,665,619 | A | * | 5/1972 | Gray | 36/117.1 |
| 4,310,951 | A | * | 1/1982 | Riedel | 24/68 SK |
| 4,387,517 | A | * | 6/1983 | Annovi | 36/118.2 |
| 4,670,946 | A | * | 6/1987 | Olivieri | 24/71 SK |
| 4,800,659 | A | * | 1/1989 | Marega | 36/117.9 |
| 4,856,210 | A | * | 8/1989 | Delery | 36/118.9 |
| 5,327,620 | A | * | 7/1994 | Chen | 24/68 SK |
| 5,495,683 | A | * | 3/1996 | Miotto et al. | 36/50.5 |
| 5,557,866 | A | * | 9/1996 | Prengler | 36/138 |
| 5,611,154 | A | * | 3/1997 | Lucchetta et al. | 36/50.5 |
| 5,816,603 | A | * | 10/1998 | Borsoi | 280/623 |
| 5,933,987 | A | * | 8/1999 | Demarchi | 36/115 |

FOREIGN PATENT DOCUMENTS

| | | | |
|---|---|---|---|
| CH | 668682 | * | 1/1989 |

* cited by examiner

*Primary Examiner*—Mickey Yu
*Assistant Examiner*—Troy Arnold
(74) *Attorney, Agent, or Firm*—Greenblum & Bernstein, P.L.C.

(57) ABSTRACT

A device for guiding a flap of a closure and, more particularly, a flap of a closure of an article of footwear. More particularly, the invention is directed to an article of footwear in the form of a sports boot equipped with at least two semi-rigid upper elements, i.e., flaps, which overlap during the closing or adjustment of the footwear, thus defining an upper flap and a lower flap, the footwear also being equipped with a tightening mechanism. The tightening mechanism, according to the invention, includes a structural arrangement for ensuring the guiding of the lower flap beneath the upper flap, the guiding arrangement prohibiting the engagement of the lower flap over the upper flap.

55 Claims, 7 Drawing Sheets

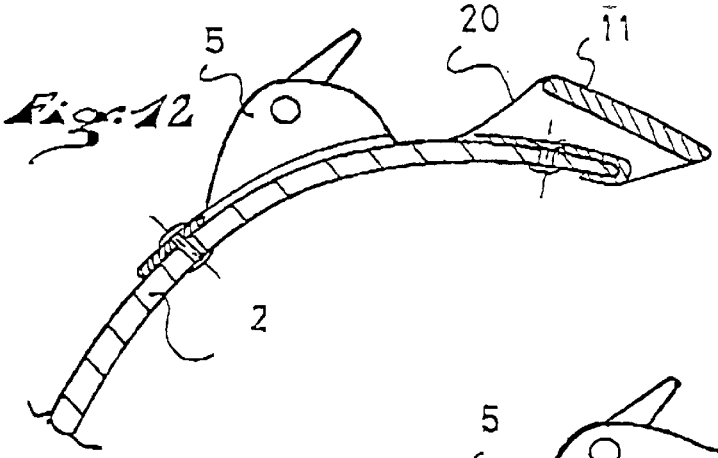
Fig: 12
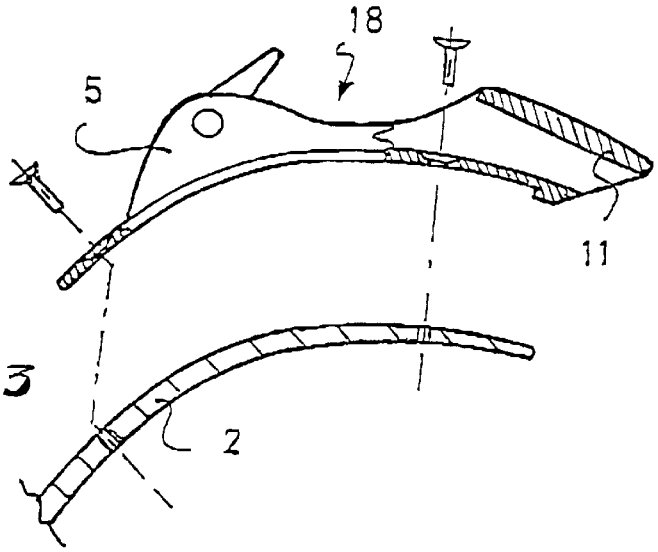
Fig: 13
Fig: 14
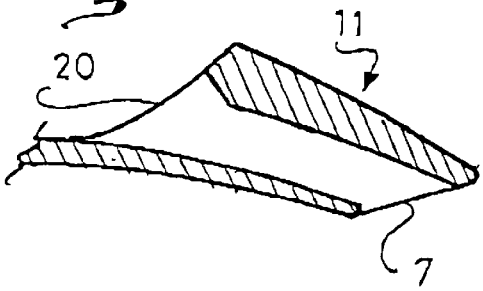
Fig: 15
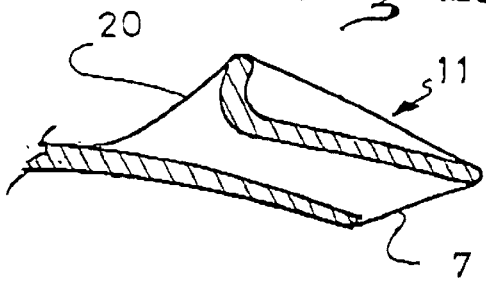

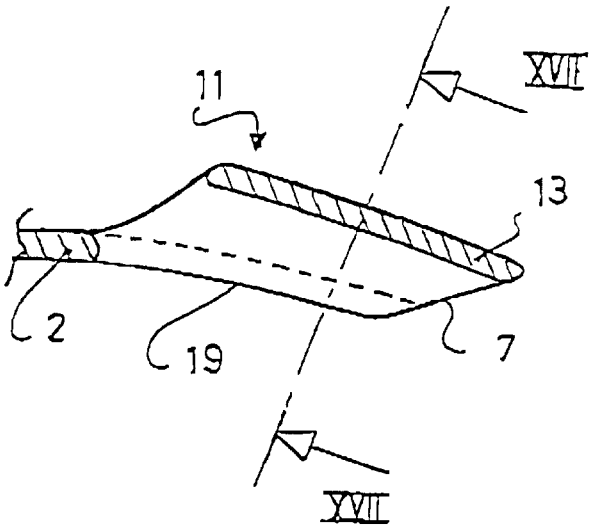
Fig. 16
Fig. 17
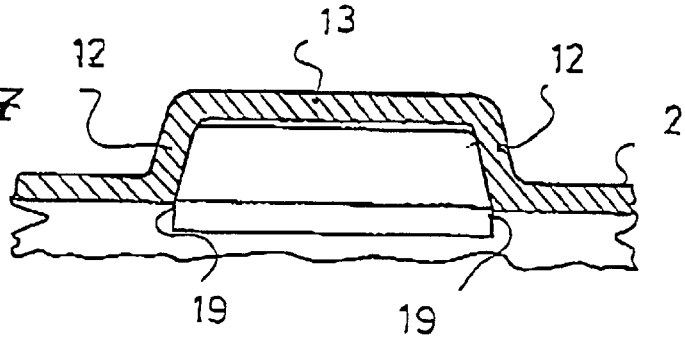
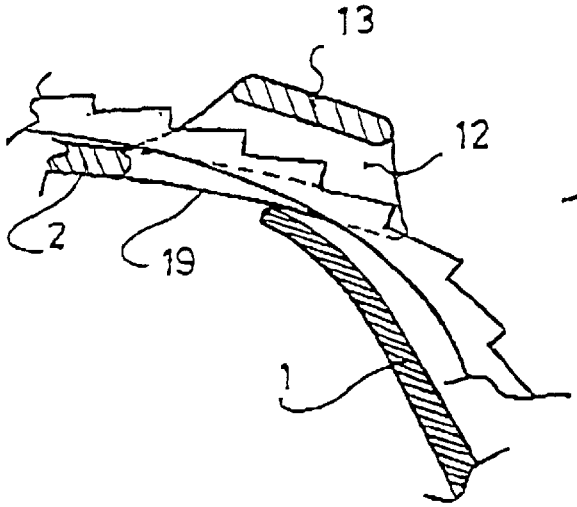
Fig. 18

DEVICE FOR POSITIONING A PAIR OF OVERLAPPING FLAPS

CROSS-REFERENCE TO RELATED APPLICATION

This application is based upon French Application No. 99 12414, filed Oct. 1, 1999, the disclosure of which is hereby incorporated by reference thereto in its entirety and the priority of which is claimed under 35 USC 119.

BACKGROUND OF THE INVENTION

1. Field of the Invention

The present invention relates to a device for guiding a flap of a closure or tightening mechanism. More particularly, the invention relates to such a device used in conjunction with an article of sports footwear, and which has at least two semi-rigid overlapping flaps. The device is preferably intended for binding the article of footwear, in the form of a boot, e.g., onto a sports apparatus, especially an apparatus used in a gliding sport, such as an in-line roller skate, that integrates therewith the article of footwear. More particularly, the invention relates to an article of footwear including a tightening mechanism which, in addition to a device for tightening the two flaps, includes a structural relationship for guiding one of the flaps beneath the other.

2. Description of Background and Relevant Information

In the field of sports boots, as in the field of devices for binding a sports boot to a gliding element, it is often necessary to ensure that the foot is properly held, either for reasons of efficiency in practicing the sport, or for reasons related to safety. To this end, it is known to equip his type of boot with a semi-rigid upper, or to equip the upper with semi-rigid upper components, such as a tightening collar. These uppers or upper components are most often equipped with overlapping portions, that can be position over one another, and which are adjusted by a tighten mechanism around the user's foot. Generally, for a good functioning of the boot, the relative position of the flaps with respect to one another is unique. Specifically, a lower flap must be located beneath an upper flap, when the flaps overlap. However, during use, the flap that should be underneath, i.e., the lower flap, frequently ends up on top.

This problem is particularly crucial when the flaps are designed to enable a complete opening, for example, in an ankle tightening collar of a walking shoe, a cross-country ski boot, or a roller skate boot.

Patent Application EP 819 390 describes a roller skate that includes a flexible liner retained at the front and rear in rigid components of the upper. Moreover, above the ankle, two semi-rigid portions of the upper ensure the holding of the user's lower leg due to a tightening mechanism having a notched strap. In this skate, the semi-rigid components of the upper, called flaps, are sized to never overlap because they are short. This choice males it possible to avoid the problem of incorrect relative positioning of the two flaps, but this can be achieved only at the expense of adequate holding of the user's foot and the comfort thereof. Indeed, in the central zone, the holding is not done by either flap, but by the notched strap.

Patent Application EP 500 479 and family member U.S. Pat. No. 5,279,052 disclose a ski boot constituted by a semi-rigid upper including four tightening hooks which can be divided into two groups. The hooks of the bottom of the foot close the bottom flaps of the boot. During normal use of the boot, this portion of the boot is not provided to open completely. Therefore, no device has been provided to prevent the flaps from incorrectly engaging with respect to one another (see FIG. 5 of EP 500 479). The top hooks, on the other hand, ensure the tightening of a portion of the upper that opens completely to allow putting on the boot. To limit the problem of incorrect engagement of the flaps with respect to one another, one of the elements of the tightening mechanism has been brought closer to the free end of one of the flaps (see FIG. 6 of this document).

If such an arrangement prevents the tightening of the flaps when they are incorrectly positioned with respect to one another, the user's attention is necessary however to ensure a correct engagement of the two flaps.

SUMMARY OF THE INVENTION

An object of the present invention is to overcome the aforementioned disadvantages. In particular, an object of the invention is to provide a device that ensures the perfect engagement of the two overlapping flaps.

The present invention primarily applies to any closure or tightening mechanism and, more particularly, that which is intended for an article of footwear, or any binding device including at least two rigid or semi-rigid elements, referred to as flaps, which overlap during the closing of same, or the adjustment of the article of footwear or of the binding device, thus defining an upper flap and a lower flap, the footwear, or the binding device, also being equipped with a tightening mechanism. In order to resolve the problem posed, the present invention provides for equipping the article of footwear with a structural arrangement that ensures the guiding of the lower flap beneath the upper flap, the guiding arrangement prohibiting the engagement of the lower flap over the upper flap.

In a preferred embodiment of the invention, the tightening mechanism includes two fixed portions, each of which is attached onto one of the flaps, a movable portion ensuring the linkage between these two fixed portions, and a keeper ensuring the guiding of a movable portion. In this embodiment, the arrangement for guiding the lower flap beneath the upper flap, which is constituted by at least one ramp, is associated with the tightening mechanism, the ramp or ramps particularly being arranged on the keeper ensuring the guiding of the movable portion of the tightening mechanism.

BRIEF DESCRIPTION OF DRAWINGS

The present invention will be better understood, and other characteristics thereof will become apparent from the description that follows, with reference to the annexed drawings showing, by way of non-limiting examples, a plurality of embodiments, and in which:

FIG. 12 shows a view of the upper flap of an article of footwear according to a third embodiment of the invention;

FIG. 13 shows a view of the upper flap of an article of footwear according to a fourth embodiment of the invention;

FIGS. 14–18 show partial views of the upper flap belonging to footwear according to alternative embodiments of the invention.

DETAILED DESCRIPTION OF THE INVENTION

Figure 1:
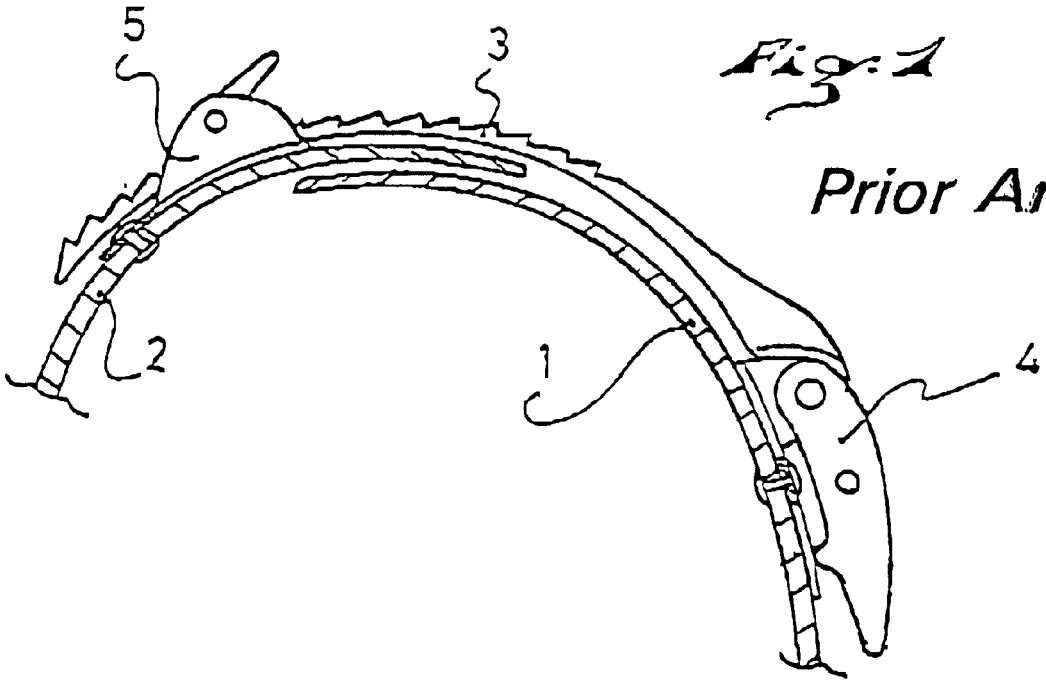
Fig. 1 Prior Art
FIGS. 1 and 2 illustrate a device for tightening two flaps according to the prior art.

FIG. 1 illustrates a device for tightening two semi-rigid flaps according to the prior art.

The two flaps 1, 2 are tightened around the user's foot by means of a notched strap 3. The latter is fixed via a lever mechanism 4 on the first flap 1. A ratchet blocker 5 is fixed in the vicinity of the free end of the second flap 2. The two flaps can constitute, for example, the two free ends of a collar for tightening the ankle in a boot for roller skating.

To guarantee the maximum of tightening amplitude, the first flap 1 must necessarily pass beneath the second flap 2.

Figure 2:
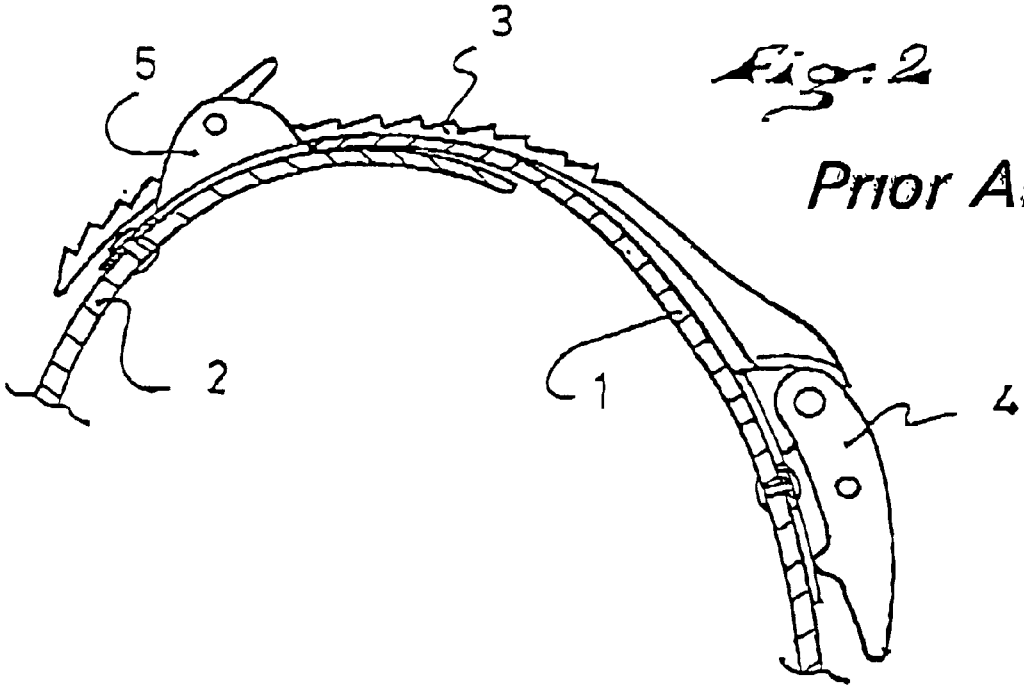
Fig. 2 Prior Art

In the case where the first flap 1 passes over the second flap 2 (FIG. 2), a correct tightening cannot occur once the first flap 1 comes in contact with the ratchet blocker, because the further sliding of the flaps on one another is no longer possible.

Figure 3:
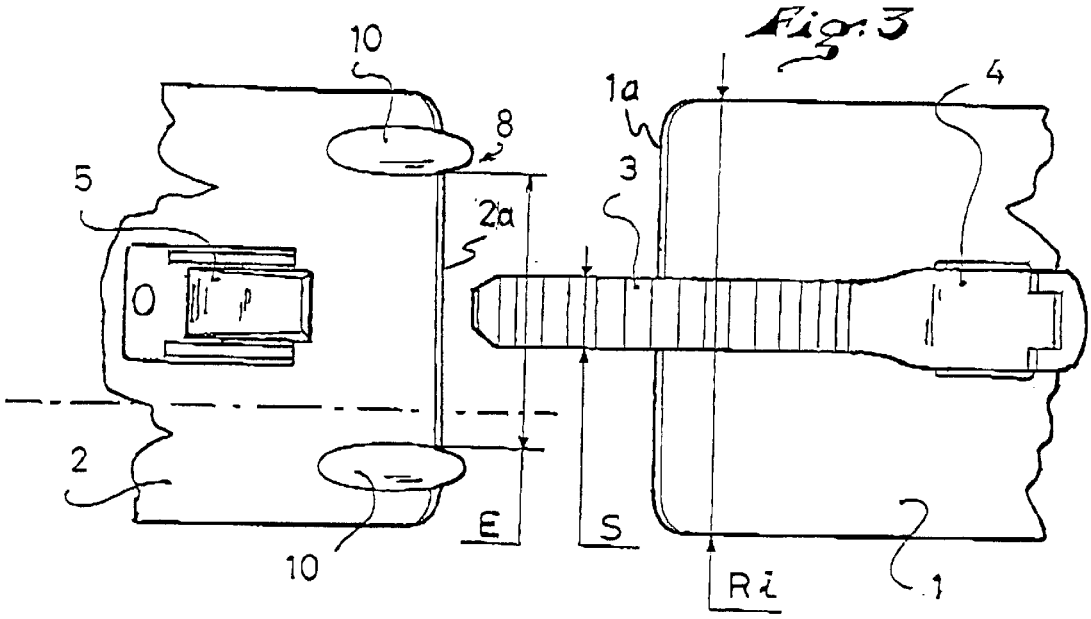
FIG. 3 shows a top view of two flaps of an article of footwear according to a first embodiment of the invention.

FIGS. 3–6 show a first embodiment of the invention. FIG. 3 shows a top view of two portions of a rigid or semi-rigid boot upper or an element for binding a boot on a gliding apparatus constituting the lower flap 1 and the upper flap 2. The two flaps are equipped with a tightening mechanism having a flexible element in the form of a notched strap 3 and two fastening components or elements, namely, a lever 4 fixed on the lower flap 1 and a ratchet blocker 5 fixed on the upper flap 2. The upper flap 2 is further equipped with a structural arrangement 8 for guiding the lower flap 1 beneath the upper flap 2.

Figure 4:
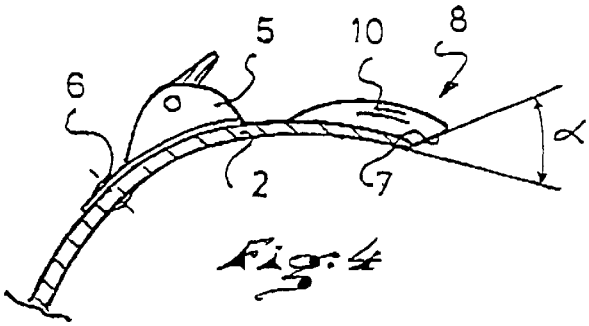
FIG. 4 shows a cross-section of the upper flap shown in FIG. 3.
Figure 5:
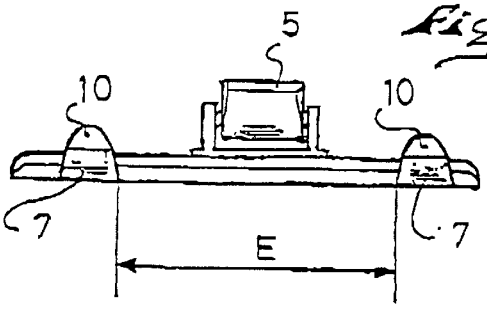
FIG. 5 shows a front view of the upper flap shown in FIG. 4.
Figure 6:
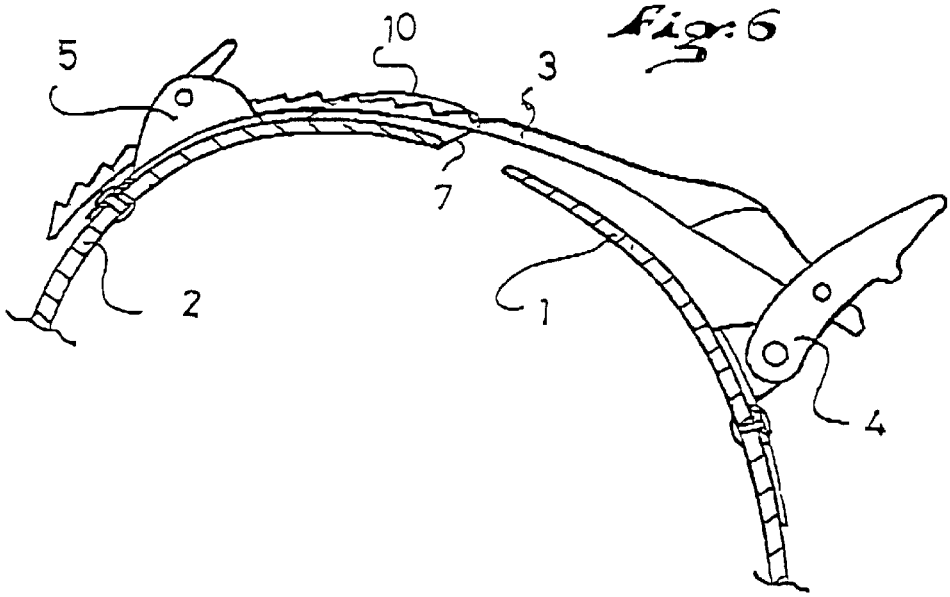
FIG. 6 shows a cross-section of the engagement of the two flaps shown in FIG. 3.
Figure 7:
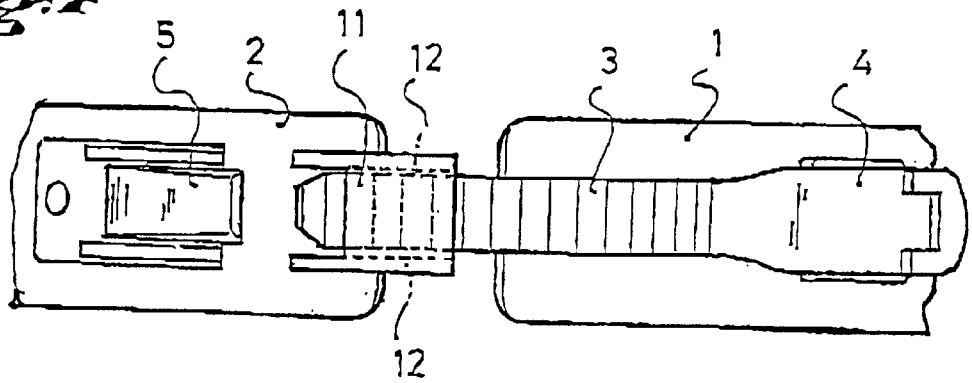
FIG. 7 shows a top view of two flaps of a footwear according to a second embodiment of the invention.
Figure 8:
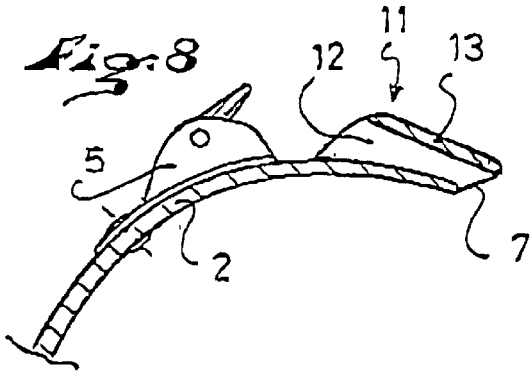
FIG. 8 shows a cross-section of the upper flap shown in FIG. 7.
Figure 9:
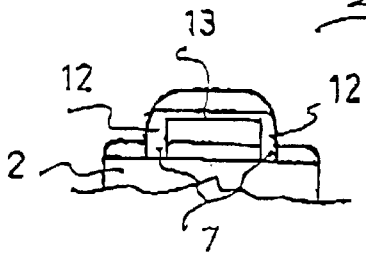
FIG. 9 shows a front view of the upper flap shown in FIG. 8.

FIGS. 4 and 5 show two views of the upper flap 2. The ratchet blocker 5 is fixed on the upper flap 2 by means of at least one rivet 6. It is contemplated that other means of affixing the ratchet blocker 5 to the flap 2 could alternatively be used, including stitching or adhesive, for example. The arrangement 8 for guiding the lower flap 1 beneath the upper flap 2 is provided at the free end 2*a* of the upper flap 2. It includes two bosses 10 that project outwardly beyond the free end 2*a* of the upper flap 2. The spacing E which the two bosses create therebetween is less than the width Ri of the lower flap 1 and is greater than the width S of the notched strap. Each boss 10 has an inclined front surface forming a ramp 7. The ramps 7 are the surfaces of the two bosses 10 that are first placed in contact with the lower flap 1, i.e., with the free end 1*a* of the lower flap. The ramp 7, together with the upper flap, forms an angle $\alpha$ comprised between 10° and 90°, preferably between 30° and 60°, whereby the ramp 7, i.e., the guiding surface for the lower flap, faces the lower flap. FIG. 6 shows how the lower flap 1 is naturally guided by the ramp 7 beneath the upper flap 2 during the closure of the lower 1 and upper 2 flaps.

As will be understood from this disclosure, the device prevents any incorrect engagement of the lower flap 1 over the upper flap 2. When the user wishes to close the component of the upper constituted by the two flaps 1 and 2, he/she naturally grabs the free end of the notched strap 3 so as to insert it into the ratchet blocker 5. The lower flap 1, which cannot then rise above the bosses 10 because the notched strap 3 prevents it from doing so, slides on the ramps 7 until it occupies its position beneath the upper flap 2 (FIG. 6).

FIGS. 7–10 show a second embodiment of the invention in which the device for closing the flaps is equipped, in addition to the two fastening elements 4 and 5, with an arrangement in the form of a keeper 11 for guiding the notched strap. The keeper 11 is provided at the free end of the upper flap. It includes two lateral posts 12 connected by a bridge 13. The bridge 13 is substantially planar and forms a non-zero angle with the upper flap 2.

Figure 11:
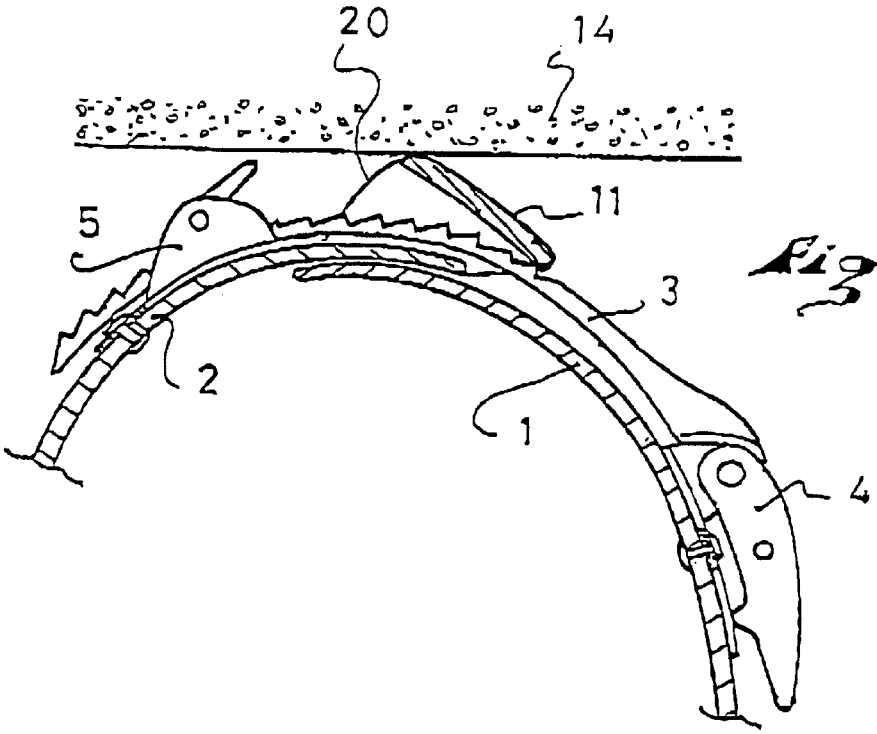
FIG. 11 shows a view to FIG. 10 at the completion of the engagement of the two flaps.

This construction has several advantages. Initially, the approaching phase of the notched strap 3 up to the ratchet 5 occurs more smoothly. Indeed, a keeper, whose bridge would form a zero angle with the upper flap 2, would require an overly sharp variation in the inclination of the notched strap, when the latter penetrates into the keeper. The second advantage of providing the bridge of the keeper with a non-zero inclination is such that the side of the keeper that faces the ratchet 5 is higher than the flap 2 and can thus serve as a deflector for protecting the ratchet 5 and for preventing an ill-timed unlatching of the ratchet 5. This aspect is shown in FIG. 11, where one sees how the ratchet 5 is protected by the keeper 11 during an undesired contact of the device with the ground 14 or any other surface. Finally, a third advantage lies in the fact that, due to a very wide opening 20 of the keeper 11 on the side of the ratchet, the risks of blocking the notched strap, when one desires to pull it back to space the two flaps apart, are limited.

Furthermore, the arrangement for guiding the lower flap is integrated in this keeper 11; it is constituted of a ramp 7 provided on each of the surfaces of the lateral posts 12 of the keeper.

Figure 10:
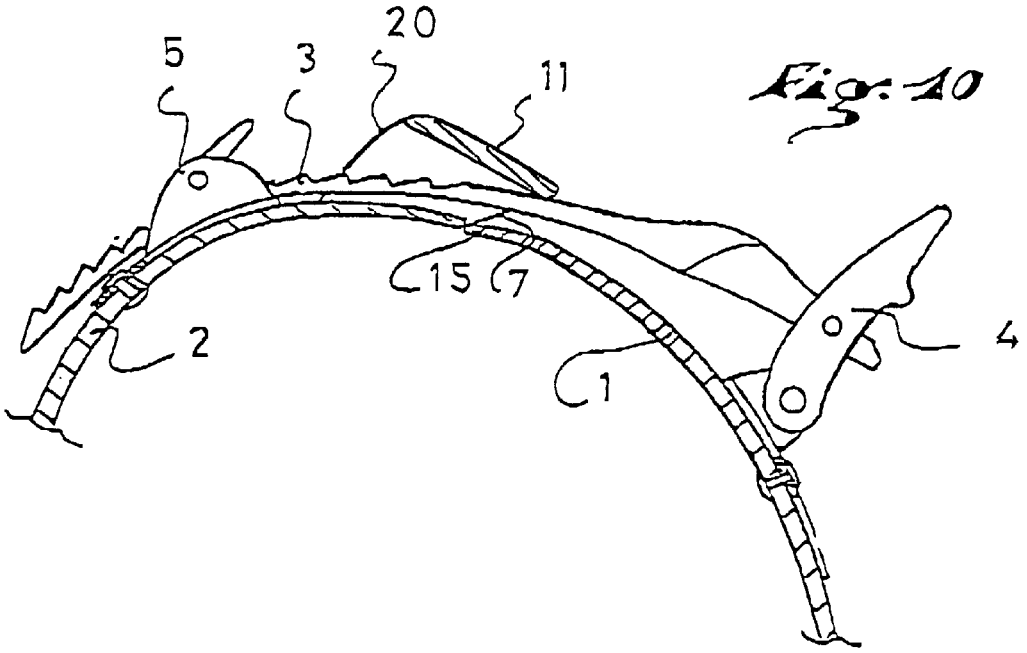
FIG. 10 shows in cross-section the start of engagement of the two flaps shown in FIG. 7.

The closing of the collar of a boot or of a device for binding a boot on a gliding apparatus occurs as follows. Initially, the notched strap 3 engages into the keeper 11. When the strap 3 engages further into the keeper 11, then into the ratchet blocker 5, the lower flap 1 comes in contact with the ramps 7. The ramps cause the lower flap to slide beneath the upper flap 2. FIG. 10 shows the end 15 of the lower flap 1 that is guided by the ramps 7 under the upper flap 2.

As in the embodiment that has just been described, when the device for guiding the flaps is associated with an arrangement for guiding the flexible element of the flap tightening mechanism, which is here in the form of a keeper 11, the user can close and then tighten the collar correctly without taking any particular precaution. He only needs to introduce the end of the flexible element into the keeper 11, and to perform the natural motion of closing the collar.

In the two previously described embodiments, the arrangement for guiding the lower flap is provided either on one or more projecting portions of the upper flap or on a keeper, inserted between the two fastening elements 4 and 5. In both cases, it is a single piece construction.

In a third embodiment of the invention shown in FIG. 12, the keeper 11, which includes the arrangement for guiding the flap, is an attached piece fixed by any appropriate means, for example, rivets, to the free end of the upper flap 2. In the same way, one can envision attaching, on the upper flap, bosses that have a shape similar to the bosses 10 described in the first embodiment.

In a fourth embodiment of the invention shown in FIG. 13, the keeper 11 is a part of a sub-assembly 18 that also includes the means for fastening the upper flap, which, in this case, is a ratchet blocker 5.

FIGS. 14 and 15 show two examples of a keeper 11, on which the ramps 7 are provided according to the invention. The shape of these keepers 11 is not the same as the shape of the keepers shown in FIGS. 7–13; it is noted, however, that the opening 20 of the keeper on the side of the ratchet is oversized so as to avoid the blocking of the notched strap when one wishes to open or unfasten the collar constituted by the two flaps.

Generally, the rigid or semi-rigid upper components involved in this application are obtained by molding. For reasons related to the demolding rate and the manufacturing cost of the molds, one will seek to avoid the superposition of material, such as that present in the embodiment shown in FIGS. 7–11, where the bridge 13 of the keeper 11 is superposed on the end of the upper flap 2. FIGS. 16 and 17 show another embodiment in which the portion of the upper flap 2 located under the bridge 13 is eliminated. In this embodiment, the arrangement for guiding the lower flap beneath the upper flap is also in the form of ramps 7 provided on the front surfaces of the lateral posts 12 of the keeper 11.

In a variation of the previous embodiment, shown in FIGS. 17 and 18, the arrangement for guiding the lower flap beneath the upper flap is simply constituted by the lower edges 19 of the lateral posts 12. According to the invention, whether the guiding arrangement is provided by ramp structures 7 or 19, such guiding arrangement can be said to be integrated or incorporated with a flap for guiding and thereby positioning the other flap. That is, the guiding arrangement is fixed with regard to the flap, either by being affixed against movement therewith or by being made unitarily therewith. It can be seen in the various embodiments of the invention, the surface of the guide for the lower flap, such as the ramp structures 7 or 19, faces the lower flap.

For reasons of simplicity of the disclosure, a choice was made to represent the tightening mechanism as including, on the upper flap 2, a ratchet adapted to cooperate with a notched strap, which is itself fixed on the lower flap 1 by means of a lever 4. This is only an example, and all of the tightening mechanisms currently used in sporting equipment are perfectly adaptable to be combined with an arrangement ensuring the guiding of the lower flap beneath the upper flap according to the invention. For reference, one cites the case here where the notched strap is fixed directly on one of the flaps, whereas the ratchet is fed on the other flap by means of a lever (EP 819 390), or the case where the flexible element of the tightening system is a tie rod or buckle associated with a lever and where the second fastening element is a rack (EP 500 479 and U.S. Pat. No. 5,279,052). These last two types of tightening mechanisms lend themselves especially to the use of the guiding device according to the invention, because they include a flexible portion that extends beyond the flap. For this purpose, therefore, the disclosures of EP 819 390; EP 500 479; and U.S. Pat. No. 5,279,052 are hereby incorporated by reference thereto in their entireties.

The disclosure of the invention has been confined to a general description of the invention, in the sense that only the free ends of the upper and lower flaps, adapted to overlap, have been described. The invention is however particularly adapted to any sporting equipment having at least two rigid or semi-rigid flaps, i.e., roller skates, ski boots, snowboard boots and bindings, for example. In this latter case, the binding device is generally constituted of a plurality of tightening collars or buckles that hold the boot of the snowboard user at various points. An arrangement for guiding one of the flaps of the collar beneath the other, as provided by the invention, can be used on each of these buckles.

Figure 19:
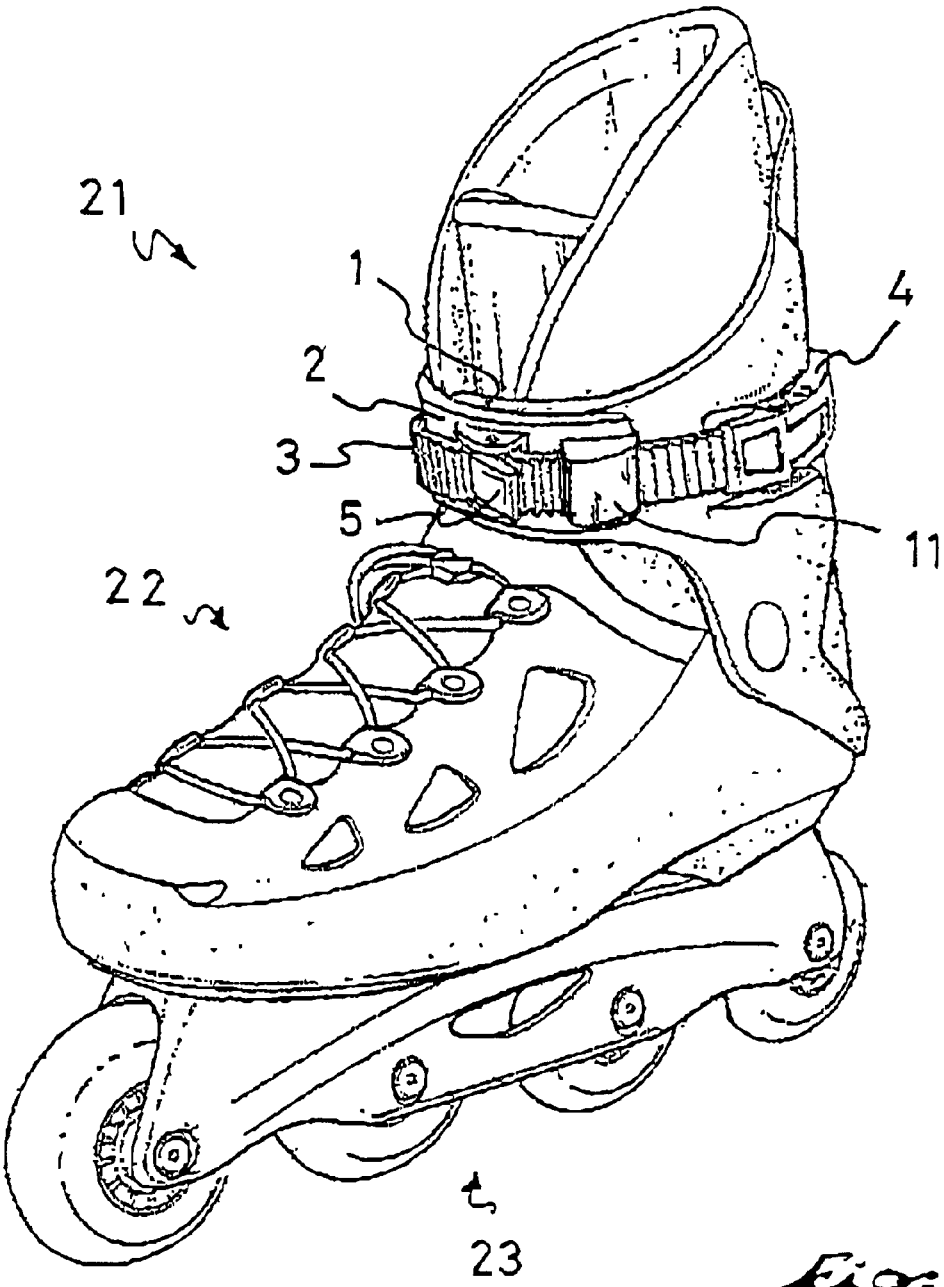
FIG. 19 illustrates an exemplary skate and boot thereof, with which the tightening mechanism of the invention is incorporated.

FIG. 19 shows an example of the guiding device, constructed according to an embodiment of the invention, embodied in an in-line roller skate 21, which includes a boot 22 and a chassis 23. Of course, as mentioned above, the device could be applied merely to a boot, independent of any skate, ski, or other sports item. As shown in FIG. 19, the boot 22 of the skate includes a pair of flaps 1, 2, in which the upper flap 2 has mounted thereon the ratchet blocker 5 and the keeper 11, and the lower flap 1 has mounted thereon the notched strap 3 and lever mechanism 4.

What is claimed is:

1. In combination, a pair of overlapping flaps and a device for positioning the overlapping flaps, said combination comprising:

an upper flap and a lower flap;

an upper flap and lower flap tightening mechanism; and at least one lower flap engagement guide facing said lower flap and extending in a direction to guide said lower flap downwardly beneath said upper flap and to prohibit positioning of said lower flap above said upper flap, said lower flap engagement guide being distinct from said tightening mechanism;

wherein said lower flap engagement guide is constituted by at least one ramp forming, together with said upper flap, an angle of less than 90°.

2. The combination according to claim 1, wherein:

said tightening mechanism comprises at least a first tightening component affixed to said upper flap and at least a second tightening component affixed to said lower flap, and a flexible portion associated with one of said first and second tightening components, said flexible portion comprising a link between said first and second tightening components and at least part of a positional adjustment device between said upper and lower flaps.

3. The combination according to claim 2, wherein said flexible portion is a hook associated wit a lever.

4. The combination according to claim 2, wherein said flexible portion is a strap.

5. The combination according to claim 4, wherein said strap is notched.

6. The combination according to claim 2, further comprising:

a device for guiding said flexible portion, said device being positioned between said first and second tightening components.

7. The combination according to claim 6, wherein:

said device for guiding said flexible portion is associated with said guide for guiding said lower flap beneath said upper flap.

8. The combination according to claim 6, wherein:

said upper flap includes a free end; and said device for guiding said flexible portion is a keeper fixed to said free end of said upper flap.

9. The combination according to clam 1, wherein:

said angle is comprised between 10° and 90°.

10. The combination according to claim 1, wherein:

said angle is comprised between 30° and 60°.

11. The combination according to claim 8, wherein:

said guide is constituted by at least one ramp, said ramp being constituted by a portion of said keeper, said ramp forming, together with said upper flap, an angle of less than 90°.

12. The combination according to claim 11, wherein:

said angle is comprised between 10° and 90°.

13. The combination according to claim 11, wherein. said angle is comprised between 30° and 60°.

14. The combination according to claim 11, wherein:

said keeper includes a pair of laterally opposed sides; and said at least one ramp comprises a ramp arranged on at least one of said sides of said keeper.

15. The combination according to claim 14, wherein:

said at least one ramp comprises a respective ramp arranged on each of said sides of said keeper.

16. The combination according to claim 15, wherein:

said keeper further comprises a substantially planar bridge connecting said laterally opposed sides, said bridge forming a non-zero angle with respect to a tangent plane of said upper flap, at said free end of said upper flap.

17. The combination according to claim 16, wherein:

said keeper is unitary with said upper flap.

18. The combination according to claim 16, wherein:

said keeper is an element attached onto said upper flap.

19. The combination according to claim 16, wherein:

said first tightening component is a ratchet;

said keeper and said ratchet are part of a single piece, said singly piece being attached onto said upper flap.

20. The combination according to claim 2, wherein:

said first tightening component is a ratchet;

said flexible portion is a notched strap; and said ratchet is capable of blocking said notched strap.

21. The combination according to claim 16, wherein:

said upper flap is recessed beneath said bridge of said keeper.

22. The combination according to claim 1, wherein;

said upper and lower flaps are made of a semi-rigid material.

23. The combination according to claim 1, wherein:

said at least one guide is integrated with said upper flap.

24. The combination according to claim 23, wherein:

said at least one guide includes a surface extending upwardly above a lowermost surface of said upper flap.

25. The combination according to claim 23, wherein:

each of said upper flap and said lower flap includes a respective free end; and said at least one guide includes a surface extending beyond said free end of said upper flap for being engaged with said free end of said lower flap.

26. An article of footwear comprsing:

a pair of flaps adapted to be positioned at least forwardly of a lower leg of a user, said pair of flaps being positioned for overlapping during closing or adjustment of the article of footwear, said pair of flaps including an upper flap and a lower flap, said upper flap overlapping said lower flap;

an upper flap and lower flap tightening mechanism to tighten said upper and lower flaps against the lower leg of the user; and at least one lower flap engagement guide facing said lower flap and extending in a direction to guide said lower flap downwardly beneath said upper flap and to prohibit positioning of said lower flap above said upper flap, said lower flap engagement guide being distinct from said tightening mechanism;

wherein said guide is constituted by at least one ramp forming, together with said upper flap, an angle of less than 90°.

27. An article of footwear according to claim 26, wherein:

said tightening mechanism comprises at least a first tightening component affixed to said upper flap and at least a second tightening component affixed to said lower flap, and a flexible portion associated with one of said first and second tightening components, said flexible portion comprising a link between said first and second tightening components and at least part of a positional adjustment device between said upper and lower flaps.

28. An article of footwear according to claim 27, wherein said flexible portion is a hook associated with a lever.

29. An article of footwear according to claim 27, wherein said flexible portion is a strap.

30. An article of footwear according to claim 27, wherein said strap is notched.

31. An article of footwear according to claim 27, further comprising:

a device for guiding said flexible portion, said device being positioned between said first and second tightening components.

32. An article of footwear according to claim 31, wherein:

said device for guiding said flexible portion is associated with said guide for guiding said lower flap beneath said upper flap.

33. An article of footwear according to claim 31, wherein:

said upper flap includes a free end; and said device for guiding said flexible portion is a keeper fixed to said free end of said upper flap.

34. An article of footwear according to claim 26, wherein:

said angle is comprised between 10° and 90°.

35. An article of footwear according to claim 26, wherein:

said angle is comprised between 30° and 60°.

36. An article of footwear according to claim 33, wherein:

said guide is constituted by at least one ramp, said ramp being constituted by a portion of said keeper, said ramp forming, together with said upper flap, an angle of less than 90°.

37. An article of footwear according to claim 36, wherein:

said angle is comprised between 10° and 90°.

38. An article of footwear according to claim 36, wherein:

said angle is comprised between 30° and 60°.

39. An article of footwear according to claim 36, wherein:

said keeper includes a pair of laterally opposed sides; and said at least one ramp comprises a ramp arranged on at least one of said sides of said keeper.

40. An article of footwear according to claim 39, wherein:

said at least one ramp comprises a respective ramp arranged on each of said sides of said keeper.

41. An article of footwear according to claim 40, wherein:

said keeper further comprises a substantially planar bridge connecting said laterally opposed sides, said bridge forming a non-zero angle with respect to a tangent plane of said upper flap, at said free end of said upper flap.

42. An article of footwear according to claim 41, wherein said keeper is unitary with said upper flap.

43. An article of footwear according to claim 41 wherein:

said keeper is an element attached onto said upper flap.

44. An article of footwear according to claim 41, wherein:

said first tightening component is a ratchet;

said keeper and said ratchet are part of a single piece, said single piece being attached onto said upper flap.

45. An article of footwear according to claim 27, wherein:

said first tightening component is a ratchet;

said flexible portion is a notched strap; and said ratchet is capable of blocking said notched strap.

46. An article of footwear according to claim 41, wherein:

said upper flap is recessed beneath said bridge of said keeper.

47. An article of footwear according to claim 26, wherein:

said upper and lower flaps are made of a semi-rigid material.

48. An article of footwear according to claim 27, wherein:

said at least one guide is integrated with said upper flap.

49. An article of footwear according to claim 48, wherein:

said at least one guide includes a surface extending upwardly above a lowermost surface of said upper flap.

50. An article of footwear according to claim 48, wherein:

each of said upper flap and said lower flap includes a respective free end; and said at least one guide includes a surface extending beyond said free end of said upper flap for being engaged with said free end of said lower flap.

51. An in-line skate comprising the article of footwear according to claim. 26 in combination with a chassis, said footwear being secured onto said chassis.

52. A device for positioning a pair of overlapping flaps, said device comprising:

an upper flap and a lower flap, said upper flap overlapping said lower flap;

means for moving said upper flap in relation to said lower flap to tighten said upper and lower flaps, said means comprising at least a first tightening component affixed to said upper flap and at least a second tightening component affixed to said lower flap, said first tightening component being engaged with said second tightening component to tighten said first and second flaps by movement of said upper flap in relation to said lower flap; and means, distinct from said first and second tightening components, for guiding said lower flap to a position beneath said upper flap and for prohibiting said lower flap from being guided above said upper flap;

wherein said means for guiding said lower flap further comprises at least one ramp forming, together with said upper flap, an angle of less than 90°, said ramp facing said lower flap.

53. The combination according to claim 1, wherein:

said lower flap engagement guide is fixed against movement with respect to said upper flap.

54. An article of footwear according to claim 28, wherein:

said lower flap engagement guide is distinct from said link of said flexible portion of said tightening mechanism.

55. In combination, a pair of flaps adapted to be overlapped and a device for positioning said flaps, said combination comprising:

an upper flap and a lower flap, each of said upper and lower flaps including a respective end, said upper and lower flaps being positioned for movement from a first position in which said ends of said upper and lower flaps are spaced apart to a second position in which said end of said lower flap is beneath said upper flap;

an upper flap and lower flap positioning device, said positioning device comprising at least a first tightening component connected to said upper flap, at least a second tightening component connected to said lower flap, and a strap affixed to one of said first and second tightening components and removably connected to the other of said first and second tightening components; and said upper flap and lower flap positioning device further comprising at least one lower flap engagement guide beneath said strap, said lower flap engagement guide facing said lower flap at least in said first position of said upper and lower flaps, said lower flap engagement guide extending in a direction to guide said lower flap downwardly beneath said upper flap to said second position of said upper and lower flaps and to prohibit positioning of said lower flap above said upper flap, said lower flap engagement guide being distinct from said tightening mechanism;

wherein said guide is constituted by at least one ramp forming, together with said upper flap, an angle of less than 90°.

* * * * *